US006663435B2

(12) United States Patent
Lincoln, III et al.

(10) Patent No.: US 6,663,435 B2
(45) Date of Patent: Dec. 16, 2003

(54) ELECTRICAL LOAD BALANCING POWER MODULE

(75) Inventors: Clifford F. Lincoln, III, Atlanta, GA (US); George E. Sharp, III, Kernersville, NC (US); Larry H. Smith, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/875,422

(22) Filed: Jun. 6, 2001

(65) Prior Publication Data

US 2002/0187682 A1 Dec. 12, 2002

(51) Int. Cl.[7] ..... H01R 25/00

(52) U.S. Cl. ..... 439/652; 439/121; 439/115; 439/535

(58) Field of Search ..... 439/652, 654, 439/115, 121, 535; 174/48

(56) References Cited

U.S. PATENT DOCUMENTS

| | | | | |
|---|---|---|---|---|
| 4,240,686 A | * | 12/1980 | Kurbikoff | 439/107 |
| 4,295,697 A | | 10/1981 | Grime | |
| 4,313,646 A | | 2/1982 | Milhimes et al. | |
| 4,589,715 A | | 5/1986 | Weisenburger | |
| 4,740,167 A | | 4/1988 | Milhimes et al. | |
| 5,013,252 A | * | 5/1991 | Nienhuis et al. | 439/211 |
| 5,046,963 A | | 9/1991 | Kelly | |
| 5,064,380 A | | 11/1991 | Dale et al. | |
| 5,073,120 A | | 12/1991 | Lincoln et al. | |
| 5,096,434 A | | 3/1992 | Byrne | |
| 5,244,401 A | | 9/1993 | Russell et al. | |
| 5,306,165 A | * | 4/1994 | Nadeau | 439/115 |
| RE34,977 E | | 6/1995 | McCoy | |

OTHER PUBLICATIONS

Installation of AMPINNERGY Power Junction Boxes into Movable Modular Walls, AMP Instruction Sheet 408–3247, Released Mar. 17, 1993, AMP Incorporated.

Installation of AMPINNERGY Power Junction Boxes into Movable Modular Walls, AMP Instruction Sheet 408–3279, Released Mar. 18, 1993, AMP Incorpoerated.

AMPINNERGY System, Application Specification 114–6039, Rev E, Nov. 10, 1998, AMP Incorporated.

Modular Power Distribution System, AMPINNERGY Style, Tyco Electronics, 2000.

Modular Power Distribution System, (AMPINNERGY Style), Layout and Planning Manual, 124235, Rev C, 3/00, Tyco Electronics.

800A.—5000 A. I–Line II Busway, Feeder and Plug–In Busway & Fittings, Class 5615, Aug. 1986. Square D Company.

(List continued on next page.)

*Primary Examiner*—P. Austin Bradley
*Assistant Examiner*—Edwin A. León

(57) ABSTRACT

A load balancing electrical wiring device or power strip 2 includes a tap socket assembly 20 with multiple line conductors 4 so that more than one branch circuit is present in device. The tap socket assembly 20 is connected to a circuit protection power source by a power cable 80 attached to end connectors 30 on the tap socket assembly 20. Different versions of receptacle outlets 40 can be plugged into the tap socket assembly 20 to connect different receptacle outlets 40 to different line conductors 4 and therefore different branch circuits. Receptacle outlets 40 can be replaced by a different version of the receptacle outlet to connect to a different line conductor 4 so that the branch circuits can be balanced without changing the wiring at the circuit protection power source. The tap socket assembly is positioned in a mounting enclosure 70 that includes openings 76 through which the receptacle outlets can be inserted or removed.

37 Claims, 8 Drawing Sheets

U.S. PATENT DOCUMENTS 5,549,488 A 8/1996 Berndt et al.
5,582,522 A * 12/1996 Johnson ..... 439/214
5,595,494 A * 1/1997 Wiebe ..... 174/48
5,713,757 A 2/1998 Karst et al.
5,728,970 A 3/1998 Karst et al.
5,788,521 A * 8/1998 Milan ..... 439/101
5,899,761 A * 5/1999 Crane et al. ..... 439/142
5,915,984 A * 6/1999 Rupert et al. ..... 439/171
6,036,516 A * 3/2000 Byrne ..... 439/215
6,132,257 A * 10/2000 Wang et al. ..... 337/142
6,302,743 B1 * 10/2001 Chiu et al. ..... 439/22

* cited by examiner

FIG 2
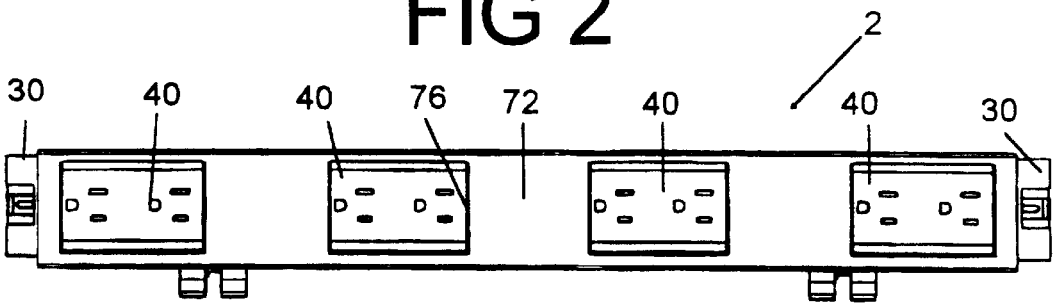
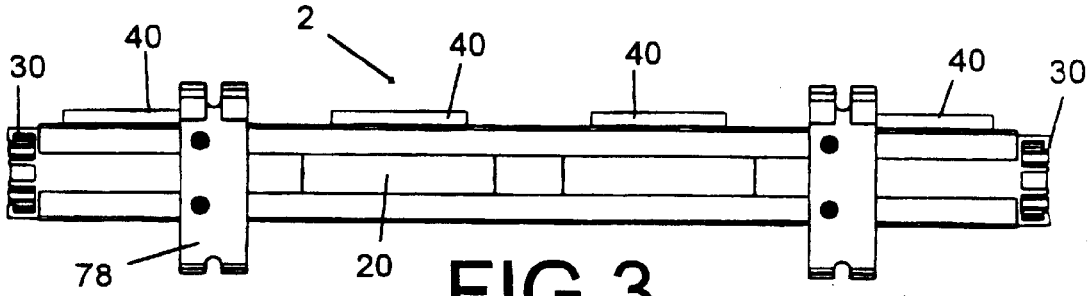
FIG 3
FIG 7A
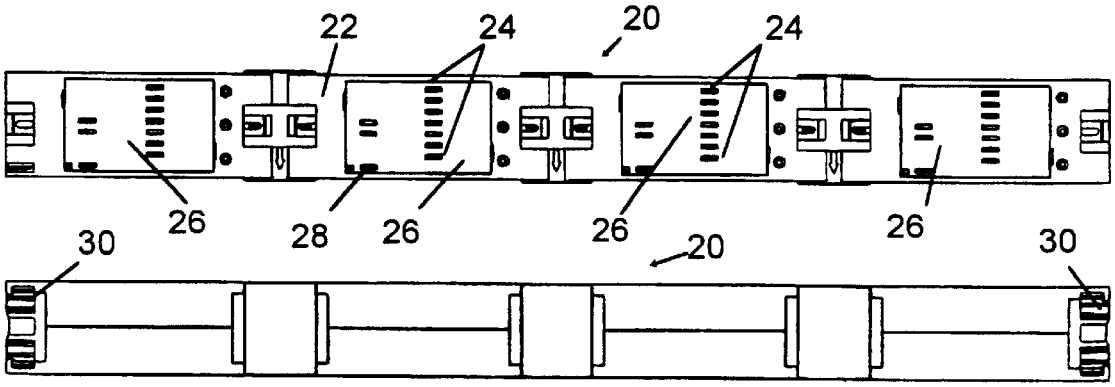
FIG 7B

FIG 5A
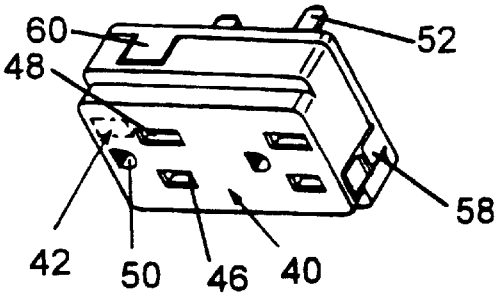
FIG 5D
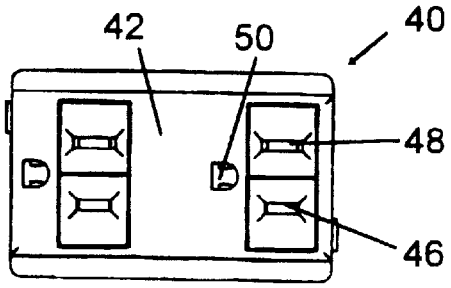
FIG 5E
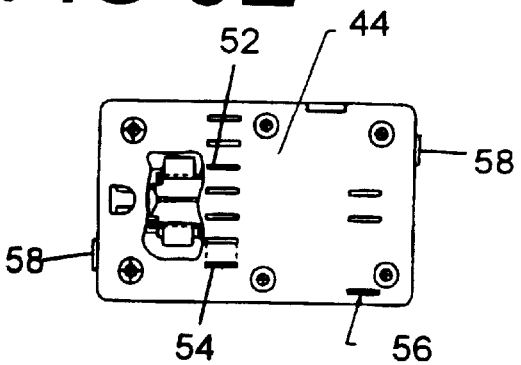
FIG 5B
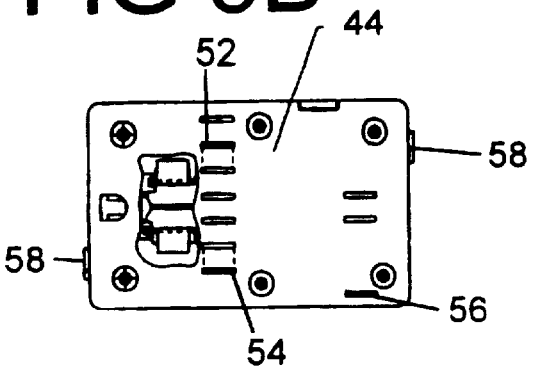
FIG 5F
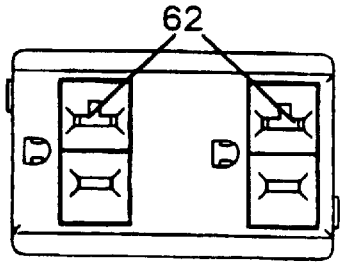
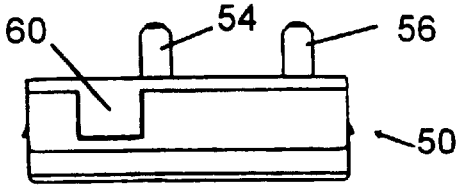
FIG 5C

ELECTRICAL LOAD BALANCING POWER MODULE

BACKGROUND OF THE INVENTION

This invention is related to wiring devices used on branch wiring circuits to deliver electrical power. More particularly, this invention is related to wiring devices, such as power strips, in which multiple branch circuits can be balanced by reconfiguring the wiring device instead of rewiring a circuit protection device or a service entrance panel associated with the wiring device.

DESCRIPTION OF THE PRIOR ART

FIG. 11 shows a conventional power strip 100 including multiple receptacle outlets 102 that are hardwired to wires in a power cable 104 that connects the power strip 100 to a source of electrical power. The power strip 100 includes receptacle outlets 102 hardwired to a single line conductor. Different versions of the power strip 100 can employ different line conductors connectable to different circuits in an AMPINNERGY power distribution system such as that shown in U.S. Pat. No. 5,073,120, incorporated herein by reference. If a problem, such as an overload condition or power spikes, exists on one of the branch circuits of which a particular line conductor is a part, then additional electrical appliances or electronic components cannot be attached to unused outlets on that branch. Thus, not all receptacle outlets may be available, and when a new appliance is connected to a branch circuit, other appliances may have to be disconnected or an additional power strip, employing a different line conductor may have to be used. In facilities, such as retail display counters, laboratories, classrooms, hospitals or other environments in which repeated or rapid changeovers are necessary, there may not be enough outlets to service all of the devices at that location, even though some branch circuits might be underutilized.

For conventional installations it is necessary to reconfigure the branches at the service entrance or rewire a facility. This operation requires a trained service technician or electrical or wiring consultant who may not be readily available. For instance, in a retail outlet demonstration display area electrical appliances or electronic devices must be connected to existing branch circuits via a wiring device or power strip located in a specific area. When the display area is reconfigured it is often necessary for an electrician to rewire the display area. Often the electrician is not familiar with the layout of the wiring of the facility or that layout is not adequately documented. Even though the branch circuits are identified at the service entrance or circuit protection panel, the physical location of these branch circuits and the outlets or power strips attached thereto may not be easily ascertainable because of previous relocation of display areas. Similar problems can exist in other facilities, such as laboratories or other facilities in which numerous electrical and electronic devices are repeatedly rearranged.

The AMPINNERGY modular power distribution system is one alternative for simplifying installation and rearrangement of electrical power systems. AMPINNERGY is a trademark of Tyco Electronics Corporation. This system is used in modular office systems and in raised floor systems. Electrical power in those systems is distributed through sheathed cables to junction blocks that are mounted in modular wall panel raceways of the type commonly used in cubicle walls. The cable assemblies are available as eight wire systems with four line conductors and five wire systems with three line conductors. The junction blocks can be mounted in raceways in the base of the modular walls by brackets. Connectors on the sheathed cable assemblies are mated to the ends of these junction blocks. Duplex receptacle outlets can be mated with the junction blocks on opposite faces so that equipment can be plugged into the duplex receptacles on both sides of the wall panel. After the duplex receptacle outlets have been mated to the junction boxes, raceway covers are mounted in front of the duplex receptacle modules. These covers have openings to allow access to the duplex receptacle sockets, but the duplex receptacle outlets must be mated to the junction boxes before the covers are installed. Versions of the duplex receptacles can be connected to any one of the line conductors in the cable assemblies so that a duplex receptacle can be connected to a predetermined branch circuit. The individual components of this modular power distribution system include many features, such as multiple wires in cable assemblies and receptacle sites on opposite sides so that the components can be assembled in a wide variety of configurations to meet the need of a specific work space. Modular power distribution systems of this type are also suitable for use in raised access floor systems and on power poles.

An important advantage of the AMPINNERGY modular power distribution system is that the components of the system can be physically moved when space in which they are used is rearranged. Thus when modular wall panels are moved or when access floor outlets are physically rearranged, the cable assemblies can also be physically moved because they are not permanently fixed to the building structure. Although the components of this prior art modular power distribution system can be physically rearranged, the electrical configuration or layout of the branch circuits are not changed as part of this physical reconfiguration. The breaker panel or circuit protection device layout is originally configured by a trained consultant or electrician. The branch circuit configuration defined at the circuit protection device remains the same, even though the physical position of the outlets attached to the modular wall panels or access floor stations may change. To electrically reconfigure modular power distribution systems of this type a trained consultant or electrician would normally reconfigure the branch circuits at the circuit protection device.

Commercially available modular electrical power distribution systems of this type are flexible and facilitate rearrangement of office space, computer facilities, light manufacturing sites and similar commercial and industrial space. However, conventional installations do not address situations in which the types and numbers of electrical appliances or electronic devices that are attached to the branch circuits are frequently changed. For instance in a retail facility, display areas and the demonstration appliances connected in any one area, are changed so frequently that it is not practical to change either the physical arrangement of the major wiring components or the branch circuit layout each time a retail display is modified. When more electrical appliances are attached to a branch circuit available in a retail display, the branch circuit may be overloaded or transients and spikes may be occur that could adversely affect the performance of other electronic components attached to that branch. Thus the branch circuits available in a particular location may limit the configuration of appliances that can be displayed in a given retail display area. Sales or maintenance personnel who typically reconfigure the display area typically do not have proper qualifications to reconfigure the electrical layout to meet new, and perhaps transient, requirements, and it is not practical to employ electricians to continuously make such changes. Similar problems can arise in laboratories, light manufacturing workspaces and in other facilities where frequent changeovers are common.

SUMMARY OF THE INVENTION

The instant invention provides added flexibility in situations requiring rapid changeover of the branch circuits available at a specific site. With this invention, personnel, other than electricians or trained wiring consultants, can reconfigure branch circuits available at a particular location by simply substituting a receptacle outlet connectable to a different branch circuit. Different versions of receptacle outlets are available so that an installed receptacle outlet connected to an excessively loaded branch circuit can be replaced by a different receptacle outlet that is attachable to a different line conductor. If the new branch is also overloaded, a third receptacle outlet attached to a third line conductor, and therefore a third branch circuit, can be installed. Thus the flexibility of an existing wiring layout can be greatly enhanced.

Thus according to one aspect of this invention, a load balancing power strip for distributing electrical power includes a plurality of separate line conductors. A plurality of tap sockets are located on the power strip. A plurality of receptacles, such as duplex receptacle outlets, are matable with the tap sockets. Each tap socket includes a plurality of line contacts, each separate line contact being commoned to one of the line conductors. Each receptacle includes a terminal matable with one of the line contacts. Receptacles having terminals in different positions are attachable to each tap socket so that, at each tap socket, a receptacle can be connected to any one of the line conductors. The receptacles at each tap socket are replaceable to balance loads on the separate line conductors in the power strip.

According to another aspect, a wiring device, such as a power strip, for distributing electrical power at multiple receptacle outlets includes a tap socket assembly including a plurality of individual tap sockets. An enclosure assembly with multiple openings houses the tap socket assembly that is mounted in the enclosure assembly with individual tap sockets aligned with individual openings in the enclosure assembly. Receptacle outlets are connectable to the individual tap sockets. The receptacle outlets extend through the individual openings by a distance sufficient to permit insertion and removal through the individual openings to permit connection to and disconnection from the corresponding tap sockets.

An electrical wiring assembly of this type would be suitable for use in a retail display panel to balance loads on branch circuits providing electrical power to sample electrical components on display in a retail establishment. This electrical wiring assembly would include a tap socket assembly including bus bars for carrying electrical current. The bus bars would be located in a tap socket housing. The tap socket assembly would include multiple tap sockets. Each tap socket would have electrical contacts on the bus bars aligned with apertures in the tap socket housing. Each electrical wiring assembly also includes an end connector on at least one end. A cable assembly including multiple wires and a connector could be attached to the end connector. The cable assembly would connect the bus bars and the wires to an electrical service panel to form multiple branch circuits accessible in the tap socket assembly. A hanger assembly could be attached to the tap socket assembly. The tap socket assembly would be mounted on the retail display panel by the hanger assembly. The hanger assembly also would have openings aligned with the tap sockets on the tap socket assembly to provide access to the tap sockets. Receptacle outlets of at least a first type and a second type would also be used. The first type of receptacle outlet could be attached to a first bus bar at one or more of the tap sockets and the second type of receptacle outlet could be attached to a second bus bar at one or more of the remaining tap sockets. The first and second types of receptacle outlets are interchangeable and replaceable so that loads on the first and second bus bars can be balanced by substituting one type of receptacle outlet for another type of receptacle outlet. The hanger assembly openings provide access through which the receptacle outlets can be inserted and removed so that loads on different branch circuits can be balanced by changing the type of receptacle outlet in the retail display area without rewiring the branch circuits at the electrical service panel.

BRIEF DESCRIPTION OF THE DRAWINGS

FIG. 2 is a view of the front or upper face of the load balancing power strip shown FIGS. 1A and 1B.

FIG. 3 is a view of a mounting face of the load balancing power strip showing the position of hanger brackets that can be used to suspend the load balancing power strip from a retail display rack so that the front face of the load balancing power strip will face upwardly to expose duplex receptacles located on that front face.

FIGS. 5A–5F are views of a duplex receptacle outlet that is used in the load balancing power strip of FIGS. 1–4. FIG. 5A is a three dimensional view of a receptacle outlet. FIGS. 5B–5C show first type of receptacle outlet that is intended to be connected to a first line conductor and to neutral and ground conductors in the load balancing power strip. FIG. 5B shows the rear face. FIG. 5C is a side view. FIG. 5D shows the front of the receptacle outlet. FIG. 5E shows the rear face of a second type of duplex receptacle outlet in which the line terminal is located at a different position than that shown in FIG. 5B. FIG. 5F shows a twenty ampere line receptacle contact that is used in the duplex receptacles that are used in the load balancing power strip.

FIGS. 7A and 7B are two side views of the tap socket or junction box subassembly that is mounted in the enclosure member and to which the duplex receptacles are connected to form the load balancing power strip.

DETAILED DESCRIPTION OF THE PREFERRED EMBODIMENT

Figure 1A:
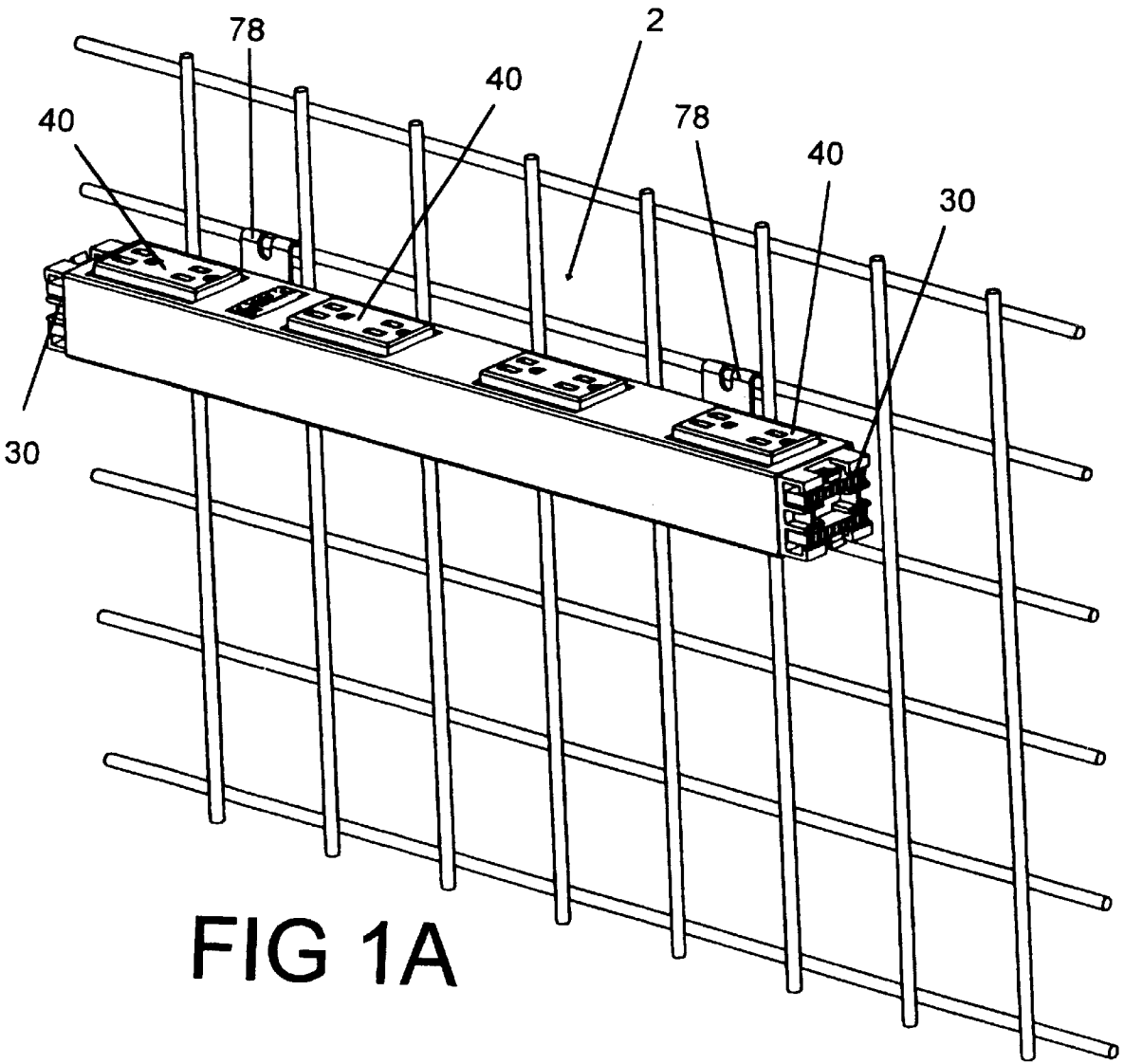
FIGS. 1A and 1B are three dimensional views of a preferred embodiment of a load balancing wiring device or power strip that can be use to supply power to multiple appliances in a retail display or other area.
Figure 1B:
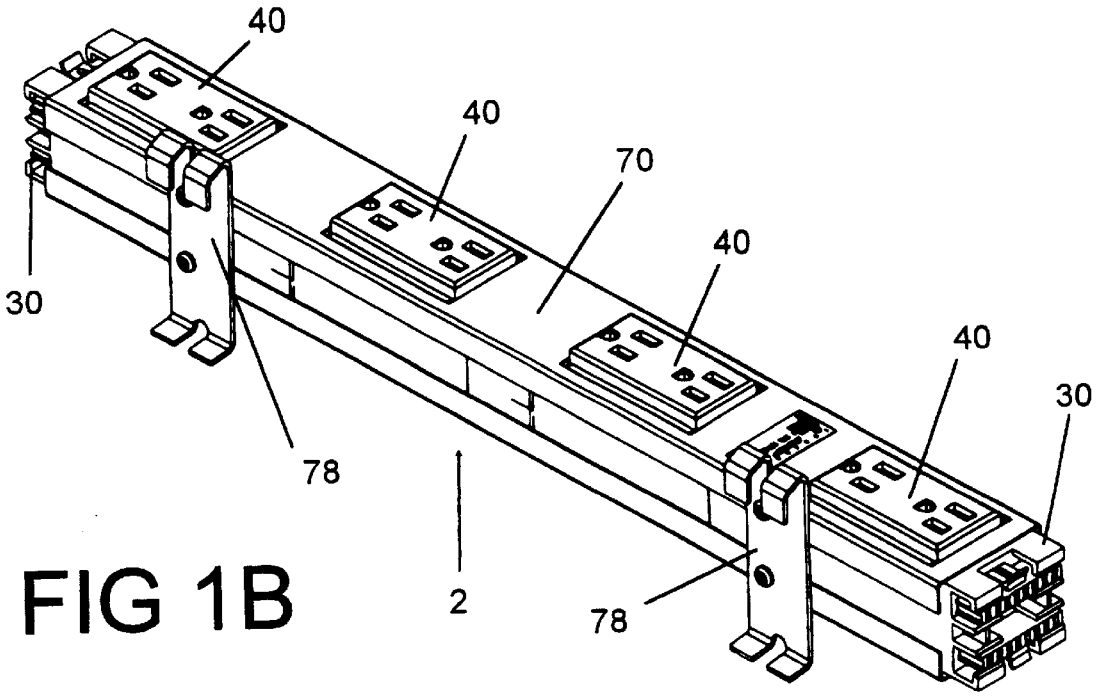
Figure 4:
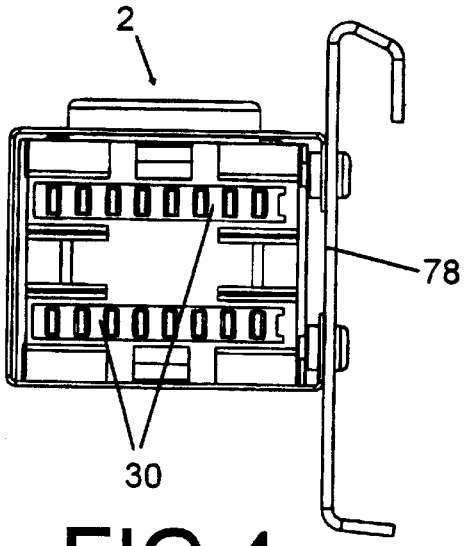
FIG. 4 is an end view of the load balancing power strip showing an end connector at one end of the power strip that can be connected to a mating connector on a cable supplying electrical power to the load balancing power strip.
Figure 6A:
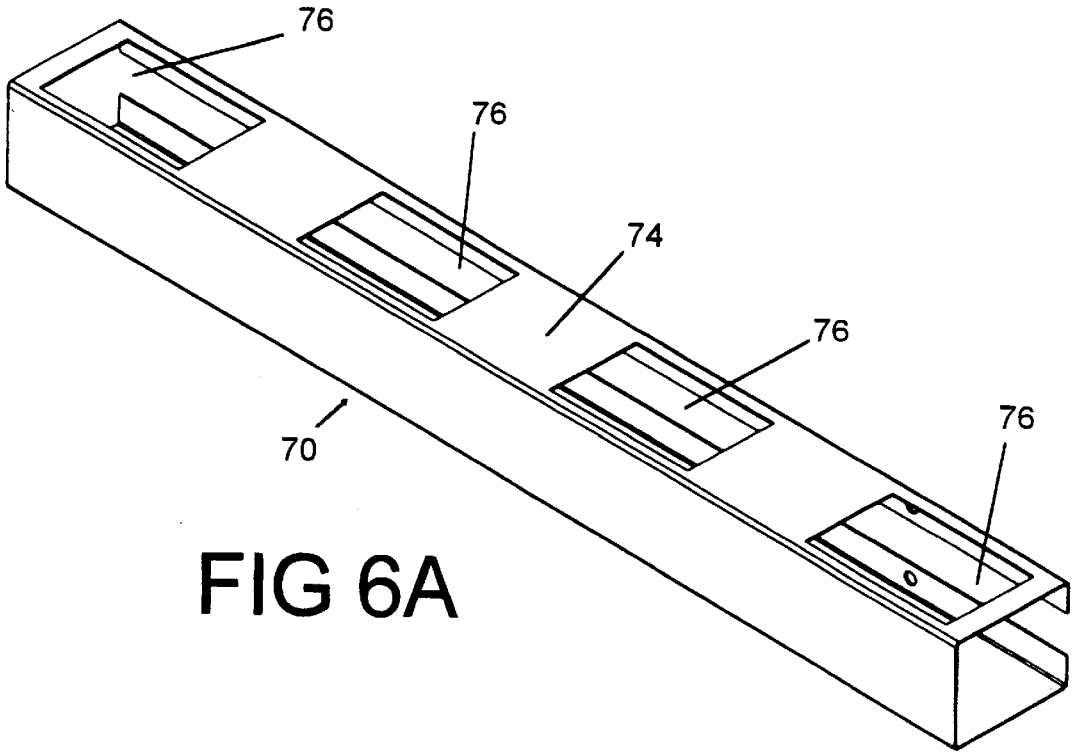
FIGS. 6A and 6B are three dimensional view of an enclosure member employed in the load balancing power strip of FIGS. 1–4.
Figure 6B:
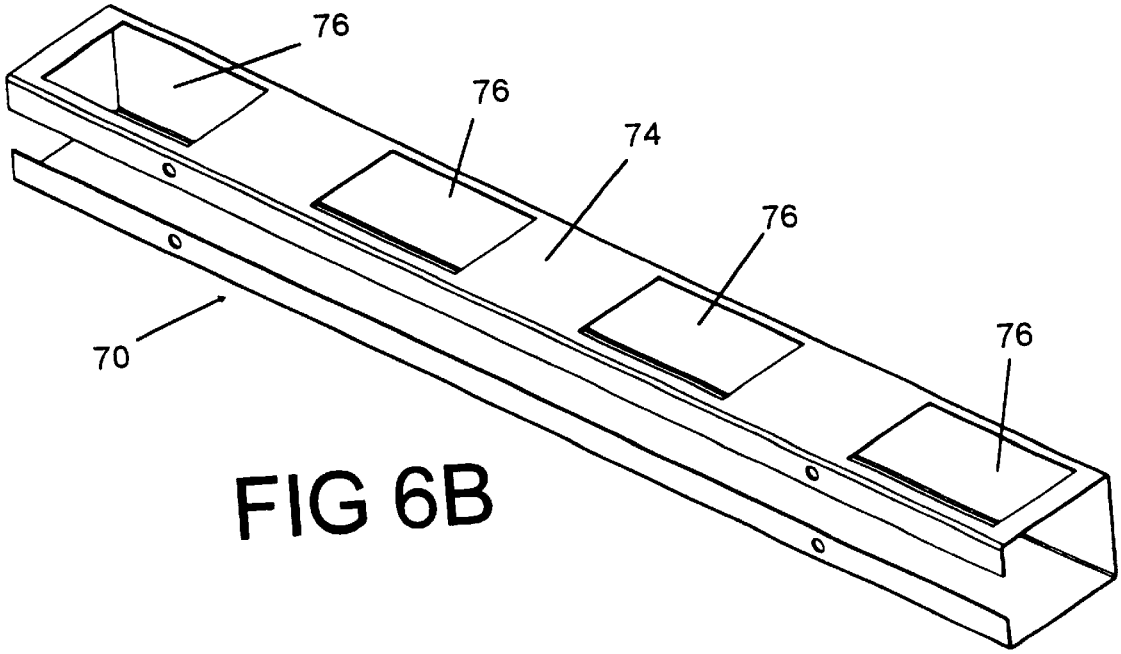

The load balancing power strip or power module 2 shown in FIGS. 1–4 can be used to deliver power to multiple appliances located in close proximity to each other. The load balancing power strip 2 includes four duplex receptacles or receptacle outlets 40 that can be individually connected to a tap socket subassembly 20, shown in more detail in FIGS. 7A and 7B. The power strip 2 also includes an enclosure member or bracket 70, shown in more detail in FIGS. 6A and 6B. The tap socket subassembly 20 is mounted in the enclosure 70, and the duplex receptacles 40 can be inserted into engagement with the tap socket subassembly 20, or removed therefrom, through openings 76 on the front or exposed face 72 of the enclosure member 70. The load balancing power strip 2 also comprises a part of an assembly that includes a power cable 80 that is used to connect the load balancing power strip 2, either directly or indirectly to a service entrance panel or circuit protection power source, such as distribution panels sold by Square D and others.

Figure 8A:
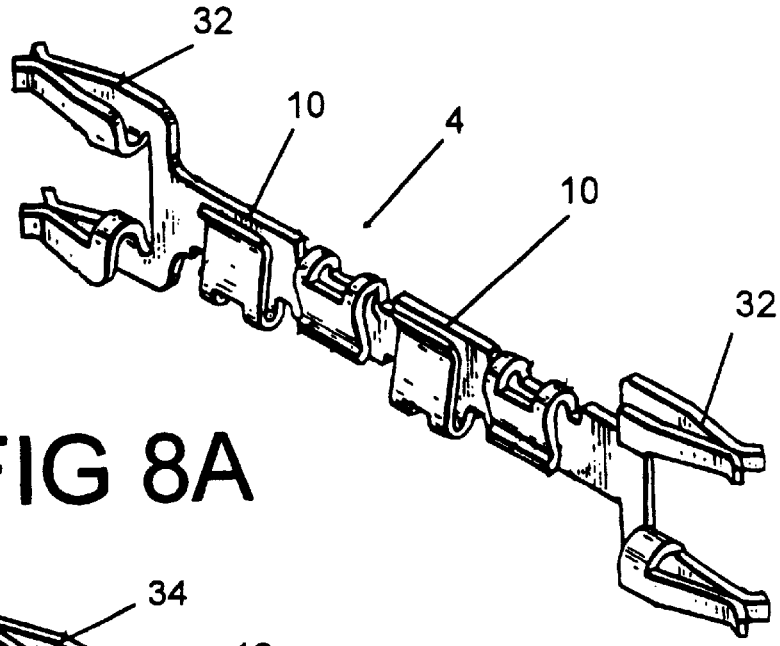
FIGS. 8A–C are views of the line, neutral and ground bus bars used in the tap socket of FIGS. 7A and 7B.
Figure 10B:
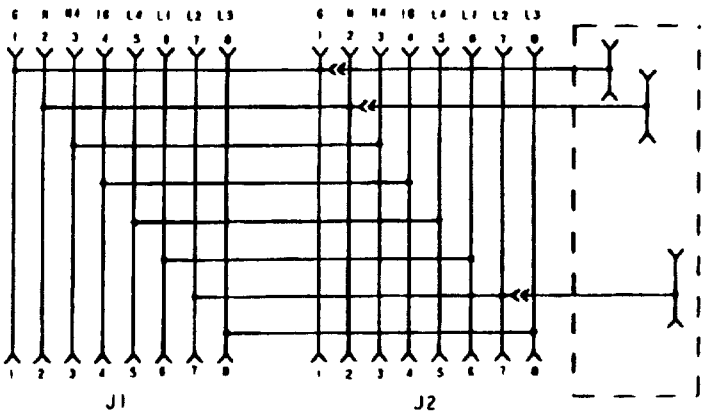
FIGS. 10A–10D are circuit schematics showing the manner in which four different duplex receptacles, with different terminal arrangements, can be connected separately to the four line conductors in the tap socket or junction box shown in FIGS. 7A and 7B.
Figure 10D:
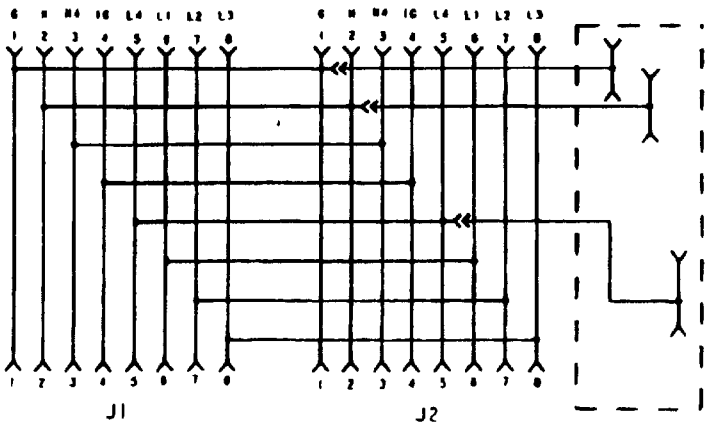
Figure 10A:
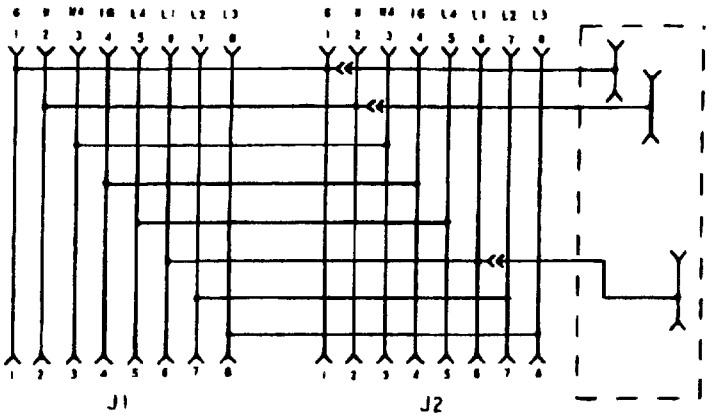
Figure 10C:
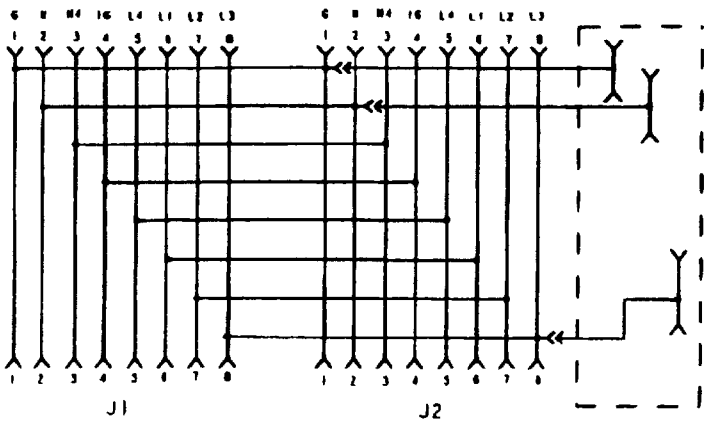

The load balancing power strip 2 can be provided in various versions, including for example a five wire version or an eight wire version. Since it is more inclusive, the eight wire version is discussed as representative of the preferred embodiment of this invention, and the conductors are shown in the schematic in FIGS. 10A and 10B. The power strip 2 includes four separate line conductors 4 and two neutral conductors 6. Two ground conductors 8, one of which is an isolated ground, are also employed. The portion of the line, neutral and ground conductors located in the tap socket subassembly 20 comprises bus bars in the preferred embodiment of this invention, although individual wires could also be employed. FIG. 8A shows that the line conductor bus bars 4 include female line contacts 10. Female neutral line contacts 12 are located on neutral bus bars 6, and the ground bus bars 8 include female ground contacts 14. These female contacts are intended to mate with male line, neutral and ground terminals on receptacle outlets 40.

The receptacle outlets 40, shown in FIGS. 5A–5F, comprise duplex receptacles suitable for receiving a conventional three bladed fifteen ampere NEMA plug. Of course, two bladed configurations or simplex receptacles could be employed in other embodiments of this invention. As shown in FIG. 5A, each receptacle outlet 40 includes a conventional receptacle line socket 46, a conventional neutral socket 48 and a conventional ground socket 50 on the front receptacle face 42. These receptacle outlets 40 can be plugged into or mated with tap sockets on the tap socket assembly 20. Each receptacle outlet 40 includes three terminal blades extending from the rear receptacle face 44. FIG. 5B shows one configuration of terminal blades for one version of receptacle outlet 40, while FIG. 5E shows another receptacle version. These two versions differ only in the position of the receptacle line terminal 52. By repositioning the line terminal 52, different receptacles can be mated to different line conductors 4 in the tap socket subassembly 20. Since four line conductors 4 are provided in the tap socket subassembly 20, as shown schematically as lines L1–L4 in FIGS. 10A–10D, four different types or versions of receptacle 40, differing only in the position of the line terminal 52, can be individually attached to one of the four line conductors 4. This capability permits different receptacles 40 to be used to balance the loads on the four line conductors 4 in the power strip 2, and this capability will be subsequently discussed in greater detail. Although the neutral terminal 54 and the ground terminal 56 are both in the same relative positions in FIGS. 5B and 5E, the preferred embodiment of this invention includes two neutral conductors 6 (N and N4 in FIGS. 10A and 10B) and two ground conductors (G and IG in FIGS. 10A and 10B).

FIGS. 5B and 5E also include a cutaway section showing the manner in which the individual terminal blades 52, 54, 56 can be clipped to receptacle socket contacts that can be employed no matter what the position of the respective terminal blades. Of course other means may be employed to connect the terminal blades to receptacle socket contacts or integral terminal blade and receptacle sockets can also be employed. FIG. 5F shows a receptacle line socket contact that has the plug mating configuration of a twenty ampere NEMA socket contact. By using a socket contact that is capable of carrying twenty amperes, the same socket contact can be used in both fifteen ampere and twenty ampere configurations. Of course the front face of a fifteen ampere receptacle would include a molded opening 62 through which a twenty ampere plug could not be inserted, so that a twenty ampere plug could not be attached to a twenty ampere branch circuit.

Figure 8B:
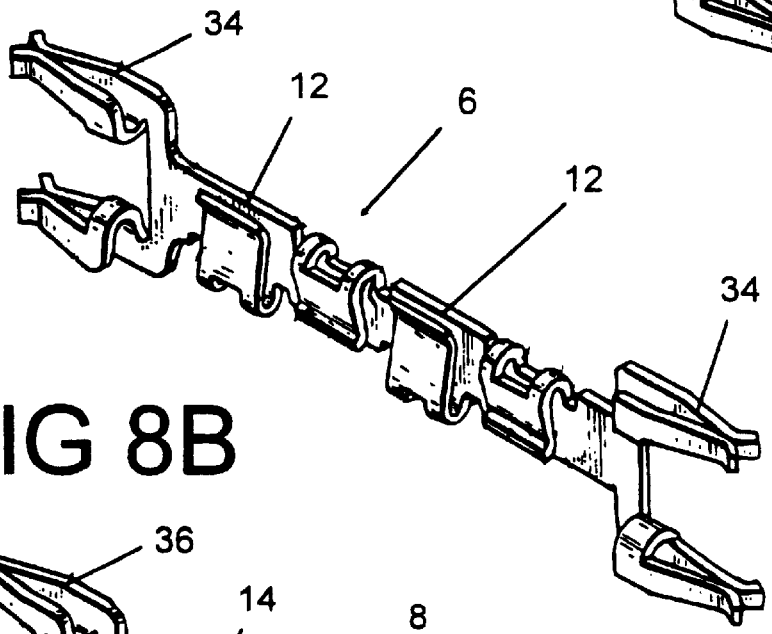
Figure 8C:
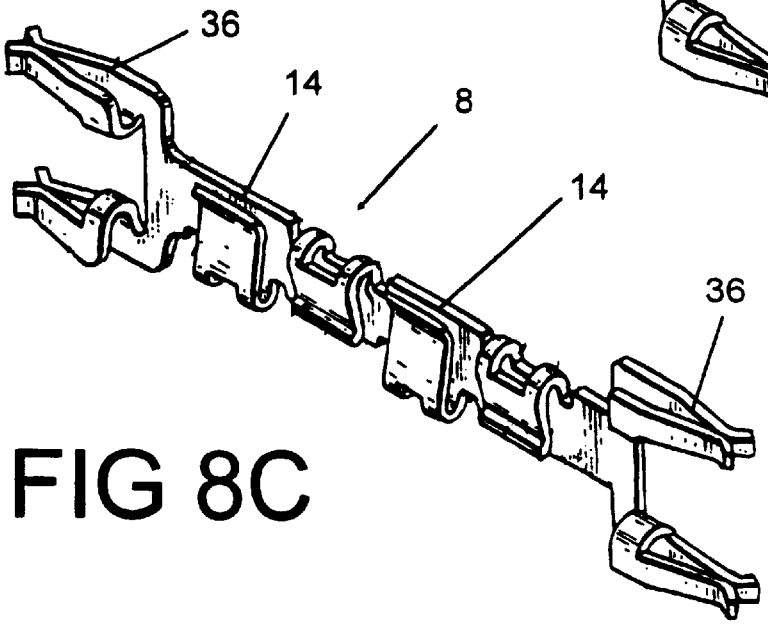
Figure 9:
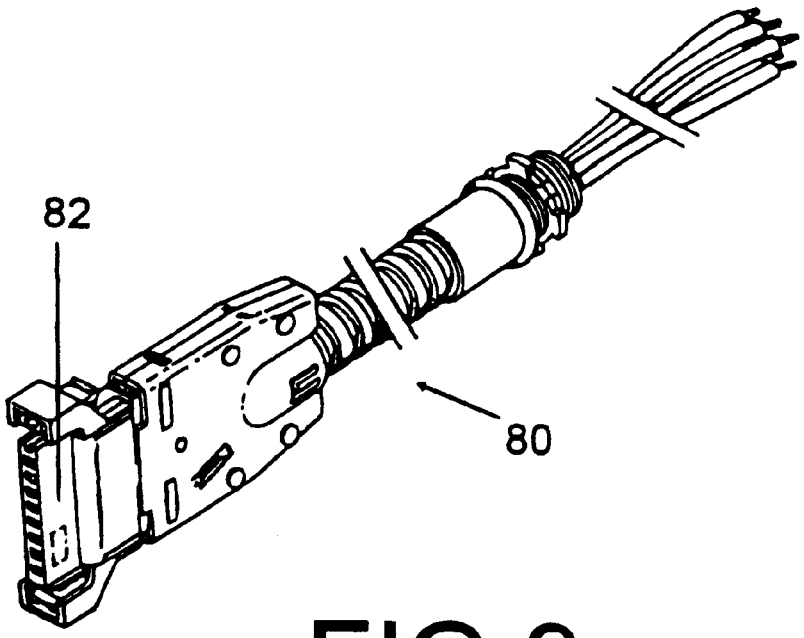
FIG. 9 is a view of a connectorized power cable that is attachable to the load balancing power strip at one end connector.
Figure 11:
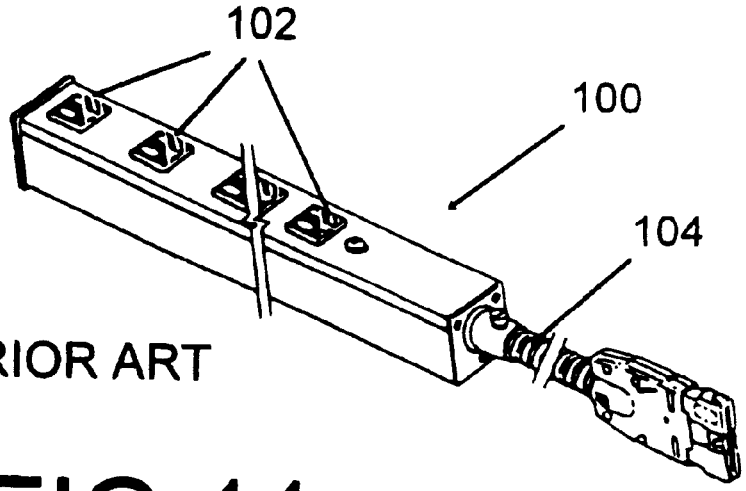
PRIOR ART FIG 11
FIG. 11 is a view of a prior art power strip, employing simplex receptacle outlets, that does not provide a load balancing capability.

The tap socket subassembly 20 enables connection and disconnection of the four types of receptacle outlets 40 to line conductors in four separate branch circuits so that any one of the different receptacle outlets 40 can be substituted for any other receptacle outlet in order to better balance the electrical loads on the four separate branch circuits. The preferred embodiment of the tap socket subassembly 20 used in the load balancing power strip 2 has four socket sites, each containing an identical array of apertures 24. These apertures 24 are aligned with the line contacts, the neutral contacts and the ground contacts, 10, 12, 14 on the bus bar conductors 4, 6, and 8 respectively, so that any one of the configurations of the receptacle outlets 40 can be connected to an appropriate one of the line conductors 4, as well as with selected neutral and ground conductors 6 and 8. In the preferred embodiment of this invention for line conductors or bus bars 4, two neutral conductors or bus bars 6 and two ground conductors or bus bars 6, shown in FIG. 8 extend between opposite ends of the molded tap socket or junction box housing 22. End connectors 30 are located on opposite ends of the tap socket subassembly 20, and these end connectors provide means for connecting the tap socket subassembly 20 and the bus bars 4, 6, 8 to wires in a power cable assembly 80, which includes a matable cable connector 82, as shown in FIG. 9. Contacts 32, 34, and 36, shown in FIGS. 8A–8C, are located in end connectors 30. End connectors 30 are located on both ends of the tap socket subassembly 20 so that the power strip 2 can be used either with other units in a pass through configuration or it can be at the end of a wiring assembly. It should be noted that the load balancing power strip 2 contains multiple line conductors and as such the wiring device or power strip 2 is part of multiple branch circuits. In the representative eight wire version, the load balancing power strip 2 is part of four branch circuits. In an alternate five wire version, the load balancing power strip 2 is part of up to three branch circuits.

The tap socket subassembly 20 shown in FIGS. 7A and 7B is a multiplex version that includes four individual tap socket modules 26 that are connected by three module connectors 28 for form a single unit. Each tap socket module 26 has a single tap site having ten apertures, each of which is aligned with one of the conductors 4, 6 or 8 and one of the tap socket contacts 10, 12 or 14. Any one of four different duplex receptacle outlets 40 can be connected at any one of the tap socket sites, so that a duplex receptacle can be connected to any one of the four line conductors 4 at any one of the tap socket sites. Although four tap socket modules 26 are attached to form the preferred embodiment of the tap socket subassembly 20, fewer or more tap socket modules 26 can be connected in a similar fashion to form other versions of the tap socket subassembly 20 used in the load balancing power strip 2.

The load balancing power strip 2 may also include an enclosure assembly 70 in which the tap socket subassembly 20 is mounted. In the preferred embodiment, the enclosure assembly 70 is formed of a sheet metal member that has been folded along four parallel fold lines to form a structure that substantially surrounds the tap socket subassembly 20. The ends of the enclosure assembly 70 are open so that a tap socket subassembly 20 can be inserted end wise into the enclosure member. The tap socket subassembly 20 can be inserted into the enclosure member 70 only if no receptacles 40 are connected to the tap socket subassembly 20 during this assembly step. One face, referred to herein as the front face or panel 72, of the sheet metal enclosure member includes a series of side by side openings 76 that are positioned to be in alignment with the tap socket sites on the tap socket modules 26 when the tap socket subassembly 20 is positioned in the enclosure member 70 to form a subassembly of the power strip 2. When the tap socket subassembly 20 is positioned in the enclosure member 70, the end connectors 30 are accessible on opposite ends of the subassembly so that a power cable 80 can be connected to the tap socket subassembly 20 to power the power strip 2. The preferred embodiment of the load balancing power strip 2 also includes a hanger bracket 78 that is mounted as part of the enclosure member 70. This hanger bracket is attached at the edges of the sheet metal enclosure panels by conventional fasteners, such as screws. This load balancing power strip 2 can be suspended on a display rack or some other mounting fixture by the hanger bracket 78 is a position to be easily accessible. In the preferred embodiment the hanger bracket 78 suspends the power strip 2 from a rack with the front face or panel 74 facing upward where it is easily accessible for connecting and disconnecting various electrical or electronic devices in a retail display area, in a laboratory, in a medical facility or in any environment in which electrical appliances are repeatedly plugged into the power strip 2. Of course this invention is not limited to a structure in which the power strip 2 is mounted or suspended in this manner. Other enclosure or mounting members can be employed, but the enclosure member 70 should provide space for inserting and removing receptacle outlets 40, such as the duplex receptacles used in the preferred embodiment, when the load balancing power strip 2 is in use. Preferably, the receptacle outlets 40 are mounted from the front or at least a readily accessible face of the power strip 2.

The interchangeable receptacle outlets 40, different versions of which can be connected to different ones of the line conductors 4, and thus different ones of the branch circuits, form a remaining component of the load balancing power strip 2. The openings 76 in the front panel of the metal enclosure 70 are large enough to permit both insertion and removal of the receptacle outlets 40 through the openings 76. The receptacle outlets 40 can thus be mated with and unmated from the socket sites in the individual tap socket modules 26 through these openings 76. In other words a version of the receptacle outlets 40 connectable to any one, but not more than one, of the line conductors 4, or branch circuits, can be both mated and unmated from an accessible face of the power strip 2. For the eight wire embodiment of this invention, four different receptacles, can be connected to the tap socket subassembly 20, so that one receptacle is connected to each branch circuit. Of course, more than one of the receptacle outlets 40 can be connected to a single line conductor 4 or branch circuit in one power strip 2. When multiple wiring devices are interconnected, so that branch circuits extend through multiple devices, it follows that more than one receptacle outlet 40 will be located on one branch. Currently the National Electric Code allows up to thirteen outlets on a single twenty ampere branch circuit. Normally in an application such as that depicted herein, no more than eight outlets would be used on a single branch.

Load balancing on the multiple branch circuits, of which the power strip 2 is a part, can thus be accomplished simply by interchanging different versions of the receptacle outlets 40 or by substituting a different version of the receptacle outlet 40 at one tap socket site when one of the branch circuits has an excessive load or an overload condition. Thus if a new electrical appliance is connected at one site, and the addition of that new appliance causes a problem on the branch circuit accessible at that site, it is now possible to merely change the type of receptacle outlet 40 at that physical site and plug the appliance into another branch circuit where it will not cause any problem. For example, if an appliance causes a voltage spike that may adversely affect other electrical appliances or electronic devices on the initial branch, it is now possible to replace the installed receptacle 40 with a different version, connectable to a different line conductor. The new appliance can then be connected at the same physical site, but to a different branch without the need to rewire the facility or change connections at the service entrance or at the circuit protection device. This change would not require a skilled technician or electrician and would not require extensive rewiring. This capability is of special importance in a facility where rapid or repeated changeovers are a normal occurrence. With versions including multiple neutral conductors in the tap socket assemblies and multiple grounds, such as isolated ground conductors, other circuit reconfigurations are also possible, even if the line conductor itself is not overloaded. With the use of simple testing probes, such as an amperage probe, the availability of a new branch connection can also be evaluated before a different version of receptacle outlet is substituted.

The individual receptacle outlets 40 each protrude through the panel openings 76 beyond the panel face 72. In the preferred embodiment of this invention, each receptacle 40 includes two deflectable latches 58 located on opposite sides of the receptacle. These latches engage ribs, not shown, at the edge of the tap socket site in which the receptacle is inserted. These latches 58 help to secure the receptacle 40 in the tap socket 20 in a conventional manner. The latches 58 are, however, accessible from the front or exterior of the enclosure 70, so that the latches 58 can be depressed to disengage the latches 58 from the ribs on the tap socket housing 22. This latch can be depressed by the users fingers, or at least with the use of simple, readily available tools, such as screwdrivers. The latches insure that the receptacle outlets can only be disconnected from the tap sockets with a minimum disengaging force that is greater than the maximum unmating force for disconnecting an electrical plug from the receptacle outlet, so that the receptacle outlets will not be disengaged when a plug is disconnected from the receptacle outlet. In addition to the latches 58, each receptacle also includes at least one key slot 60 along one side to properly orient the receptacle 40 to the tap socket site so that the receptacle terminals 52, 54 and 56 are aligned with the tap socket apertures 24. Thus the receptacles 40 can be changed over from the front of the power strip 2 without exposing the user to the line conductors 4 on the branch circuits that are to be balanced.

The preferred embodiment of this invention is representative of other configurations that can be employed to implement this invention. For example other mounting components would be apparent to one of ordinary skill in the art. For example, the tap socket assembly could be mounted on a rear bracket and a front cover plate with openings through which the receptacles would be accessible could also be employed. Other modifications that would be apparent to one of ordinary skill in the art would included the use of a tap socket assembly that included tap sockets on only one face. A tap socket assembly in which tap sockets are connected by wires instead of bus bars could also be employed. The duplex receptacle outlets of the preferred embodiment can also be replaced by simplex receptacle outlets. Therefore this invention is defined by the following claims and the preferred embodiment depicted herein is merely representative of this invention.

We claim:

1. A load balancing power strip for distributing electrical power, the power strip comprising a plurality of separate line conductors and a ground conductor and a neutral conductor, a plurality of tap socket sites spaced apart along the power strip and a plurality of receptacles, each receptacle including receptacle sockets comprising means for interconnection to an electrical plug, each tap socket site including a plurality of line contacts, each separate line contact being commoned to one of the line conductors, and each receptacle including a terminal matable with one of the line contacts and extending from a side of the receptacle opposite from the means for interconnection to an electrical plug, receptacles having terminals in different positions being attachable to each tap socket site so that at each tap socket site a receptacle can be connected to any one of the line conductors; and wherein the receptacles at each tap socket site are replaceable to balance loads on the separate line conductors in the power strip.

2. The power strip of claim 1 wherein each tap socket site includes a female line contact on each of the line conductors and each receptacle includes a male terminal matable with one of the plurality of line contacts, terminals connectable to different line contacts being located at different positions.

3. The power strip of claim 1 wherein multiple tap socket sites are part of a tap socket assembly, the tap socket assembly including an end connector comprising means for connecting the power strip to a cable for attachment to a circuit breaker panel.

4. The power strip of claim 1 including a mounting member having an opening through which the receptacles can be inserted and removed.

5. The load balancing power strip of claim 1 wherein each receptacle includes a pair of opposing sides, one side includes the means for interconnection, and another side includes the terminal extending in a direction opposite from the side including the means for interconnection.

6. The load balancing power strip of claim 1 wherein each receptacle includes opposite sides, one side includes receptacle sockets that are configured to receive the electrical plug, and another side includes the terminal that extends outward therefrom in a direction opposite from the side including the receptacle sockets.

7. The power strip of claim 1 wherein the power strip includes two neutral conductors, and each tap socket site includes two neutral contacts.

8. The power strip of claim 7 wherein the power strip includes two ground conductors, and each tap socket site includes two ground contacts.

9. The power strip of claim 1 wherein the receptacles are located on a front face of the power strip and are removable from the power strip through the front face of the power strip.

10. The power strip of claim 9 wherein the power strip includes a front panel with openings for the receptacles, the openings being positioned such that the receptacles can be removed from the power strip, leaving the tap sockets exposed through the openings for receipt of a different receptacle connectable to a different line conductor than the receptacle previously removed from the power strip, so that a load can be removed from one line conductor and connected to a different line conductor by replacing one receptacle with a different receptacle to balance the loads on the plurality of line conductors without reconfiguring an electrical panel to which the power strip can be connected.

11. A wiring device connectable to a power cable assembly for distributing electrical power at multiple receptacle outlets on the wiring device, the wiring device comprising:

a tap socket assembly including a housing with bus conductors attachable to the power cable assembly at opposite ends of the housing and including a plurality of individual tap socket sites facing transverse to the bus conductors;

an enclosure assembly having multiple openings, the tap socket assembly being mounted in the enclosure assembly with individual tap socket sites aligned with individual openings in the enclosure assembly, opposite ends of the enclosure assembly being open to permit connection of the bus conductors to the power cable assembly; and receptacle outlets connectable to the individual tap sites, the receptacle outlets extending through the individual openings by a distance sufficient to permit insertion and removal through the individual openings to permit connection to and disconnection from the corresponding tap socket sites.

12. The wiring device of claim 11 wherein each receptacle outlet includes a latch for attaching the receptacle outlet to a tap socket assembly, the latch being accessible on the exterior of the enclosure assembly.

13. The wiring device of claim 11 wherein the enclosure assembly includes at least one hanger bracket comprising means for suspending the wiring device.

14. The wiring device of claim 9 wherein the receptacle outlets is disengagable from the tap sockets with a minimum unmating force that is greater than the maximum unmating force for disengaging the electrical plug from the receptacle outlet.

15. The wiring device of claim 11 wherein each receptacle outlet includes a pair of opposing sides, one side includes a means for interconnection to an electrical plug, and another side includes a terminal extending in a direction opposite from the side including the means for interconnection.

16. The wiring device of claim 11 wherein each receptacle outlet includes opposite sides, one side includes receptacle sockets that are configured to receive an electrical plug, and another side includes a terminal that extends outward therefrom in a direction opposite from the side including the receptacle sockets.

17. The wiring device of claim 11 wherein the bus conductors extend along a length of the housing and that each top socket site faces transverse to the length of the bus connector.

18. The wiring device of claim 11 wherein the enclosure assembly includes a front face, the openings extending through the front face, so that the receptacle outlets are insertable through and removable from the front face of the enclosure assembly.

19. The wiring device of claim 18 wherein the receptacle outlets comprise duplex receptacle outlets.

20. The wiring device of claim 19 wherein the duplex receptacle outlets comprise means for attachment of an electrical plug having a current carrying capacity of no greater than 20 amperes.

21. The wiring device of claim 11 wherein the enclosure assembly extends at least partially around the tap socket assembly.

22. The wiring device of claim 21 wherein the enclosure assembly comprises a cover extending at least partially around three faces of the tap socket assembly.

23. The wiring device of claim 22 wherein the cover comprises a stamped metal plate formed to extend around at least three faces of the tap socket assembly.

24. The wiring device of claim 11 wherein the tap socket assembly includes an end connector accessible on at least one end of the enclosure assembly.

25. The wiring device of claim 24 wherein the tap socket assembly includes end connectors accessible on opposite ends of the enclosure assembly so that the wiring device comprises a feed through assembly.

26. The wiring device of claim 25 wherein the end connectors extend beyond the ends of the enclosure assembly.

27. An electrical wiring assembly for use in a retail display to balance loads on branch circuits providing electrical power to sample electrical components on display in an retail establishment, the electrical wiring assembly comprising:

a tap socket assembly including bus bars for carrying electrical current, the bus bars being located in a tap socket housing, the tap socket assembly including multiple tap sockets, each tap socket including electrical contacts on the bus bars aligned with apertures in the tap socket housing, each tap socket assembly also including an end connector on at least one end thereof;

a cable including multiple wires and a connector attachable to the end connector, the cable comprising means for connecting the bus bars and the wires to an electrical service panel to form multiple branch circuits accessible in the tap socket assembly;

a hanger assembly attachable to the tap socket assembly, the hanger assembly including means for positioning the tap socket assembly in the retail display, the hanger assembly also including openings aligned with the tap sockets on the tap socket assembly to provide access to the tap sockets;

receptacle outlets of at least a first type and a second type, the first type of receptacle outlets being attachable to a first bus bar at tap sockets, the second type of receptacle outlets being attachable to a second bus bar at second tap sockets, the first and second types of receptacle outlets being interchangeable and replaceable so that loads on the first and second bus bars can be balanced by substituting one type of receptacle outlet for another type of receptacle outlet;

wherein the openings in the hanger assembly comprise openings through which the receptacle outlets can be inserted and removed so that loads on different branch circuits can be balanced by changing the type of receptacle outlet in the retail display without rewiring the branch circuits at the electrical service panel.

28. A method of balancing branch circuits to eliminate excessive loading on an individual branch circuit comprising the steps of:

providing multiple branch line conductors and at least one ground conductor and at least one neutral conductor in a single power cable assembly extending from a circuit protection power source;

providing multiple tap sockets along the power cable assembly, each tap socket including multiple branch line bus members, at least one ground bus member and at least one neutral bus member;

plugging one type of electrical receptacle outlet of a set of receptacle outlets into the tap sockets in a direction transverse to the branch line conductors, each receptacle outlet of the set including a terminal connectable to only a one of the multiple branch line conductors, such that different receptacle outlets are pluggable to different branch line conductors; and unplugging the receptcle outlet in a direction transverse to the branch line conductors and replacing a first type of receptacle outlet pluggable to a first line conductor at a first tap socket with a second type of receptacle outlet pluggable to a second branch line conductor at the first tap socket in response to excessive loading on the first branch line conductor, to balance the loads on multiple branch circuits without relocating branch circuit conductors at the circuit protection power source.

29. The method of balancing branch circuits of claim 25 wherein the first and second receptacle outlets are each attachable to only one of the branch circuits.

30. The method of claim 28 wherein plugging one type of electrical receptacle outlet of a set of receptacle outlets into the tap sockets in a direction transverse to the branch line conductors further comprises plugging one type of electrical receptacle outlet of a set of receptacle outlets into the tap sockets in a direction transverse to the branch line conductors wherein the branch line conductors extend along a length of the power cable assembly.

31. The method of claim 28 wherein unplugging the receptacle outlet in a direction transverse to the branch line conductors further comprises unplugging the receptacle outlet in a direction transverse to the branch line conductors wherein the branch line conductors extend along a length of the power cable assembly.

32. The method of balancing branch circuits of claim 25 wherein the receptacle outlets are insertable into and removable from a front face of the cable assembly.

33. The method of balancing branch circuits of claim 32 wherein each receptacle outlet includes a latch for mechanically securing the receptacle outlet to a tap socket, the method including the step of disengaging the latch to remove a receptacle outlet form a tap socket.

34. The method of balancing branch circuits of claim 28 comprising the further step of attaching the cable assembly to at least one bracket to position multiple tap sockets in a exposed position so that individual receptacle outlets can be inserted into and removed from individual tap sockets.

35. The method of balancing branch circuits of claim 34 wherein the individual receptacle outlets are insertable into and removable from individual tap sockets through openings in the bracket in alignment with the tap sockets.

36. An electrical wiring assembly for use in a facility in which numerous electrical devices are repeatedly rearranged to balance loads on branch circuits providing electrical power to electrical devices in the facility, the electrical wiring assembly comprising:

a tap socket assembly including bus bars for carrying electrical current, the bus bars being located in a tap socket housing, the tap socket assembly including multiple tap sockets, each tap socket including electrical contacts on the bus bars aligned with apertures in the tap socket housing, the tap socket assembly also including an end connector on at least one end thereof;

a cable including multiple wires and a connector attachable to the end connector, the cable comprising means for connecting the bus bars and the wires to an electrical service panel to form multiple branch circuits accessible in the tap socket assembly;

a hanger assembly attachable to the tap socket assembly, the hanger assembly including means for positioning the tap socket assembly facility in which numerous electrical devices are repeatedly rearranged, the hanger assembly also including openings aligned with the tap sockets on the tap socket assembly to provide access to the tap sockets;

receptacle outlets of at least a first type and a second type, the first type of receptacle outlets being attachable to a first bus bar at first tap sockets, the second type of receptacle outlets being attachable to a second bus bar at second tap sockets, the first and second types of receptacle outlets being interchangeable and replaceable so that loads on the first and second bus bars can be balanced by substituting one type of receptacle outlet for another type of receptacle outlet;

wherein the openings in the hanger assembly comprise openings through which the receptacle outlets can be inserted and removed so that loads on different branch circuits can be balanced by changing the type of receptacle outlet in the facility in which numerous electrical devices are repeatedly rearranged without rewiring the branch circuits at the electrical service panel.

37. A wiring assembly for use in distributing electrical power from a service entrance into a building, the wiring assembly comprising a cable assembly including multiple branches connecting a plurality of wiring devices dispersed at spaced locations in the building to the service entrance, each wiring device having at least one set of forwardly facing apertures through which contact can be made individually with all of the branches, the forwardly facing apertures facing in a direction transverse to a length of the wire assembly, and receptacles plugged into the wiring devices through a front surface, each receptacle being connectable to only one branch, each receptacle also being replaceable by different receptacles connectable to different branches so that loads on the branches can be balanced in response to changing electrical loading by only replacing one or fewer than all receptacles without rewiring the branches at the service entrance and without the need for otherwise reconfiguring the wiring assembly.

* * * * *